US008029205B2

(12) United States Patent
Ng

(10) Patent No.: US 8,029,205 B2
(45) Date of Patent: Oct. 4, 2011

(54) RETRACTABLE WRITING INSTRUMENT

(75) Inventor: King Ming Ng, Kwan Chung (HK)

(73) Assignee: Willtech (PRC) Limited, Kwai Chung, New Territories (HK)

( * ) Notice: Subject to any disclaimer, the term of this patent is extended or adjusted under 35 U.S.C. 154(b) by 485 days.

(21) Appl. No.: 12/331,121

(22) Filed: Dec. 9, 2008

(65) Prior Publication Data

US 2010/0143020 A1 Jun. 10, 2010

(51) Int. Cl.
*B43K 7/12* (2006.01)

(52) U.S. Cl. ..... 401/112

(58) Field of Classification Search ..... 401/112, 401/109, 99

See application file for complete search history.

(56) References Cited

U.S. PATENT DOCUMENTS 3,137,276 A * 6/1964 Weisser ..... 401/111
5,413,428 A * 5/1995 Kageyama ..... 401/110
7,527,445 B2 * 5/2009 Kanari et al. ..... 401/112

* cited by examiner

*Primary Examiner* — Huyen Le
(74) *Attorney, Agent, or Firm* — Raymond R. Ferrera; Adams and Reese LLP

(57) ABSTRACT

A retractable writing instrument has a push-to-extend, push-to-retract operating mechanism assembled for life as a single module which is removeable from a body of the writing instrument. A prehensile member is connected to the operating mechanism and is moveable axially for displacing the writing tip of the cartridge between its extended and retracted positions. The prehensile member has resilient parts adapted for grasping the end of the cartridge inserted through an aperture in the operating mechanism module and pressed into a cavity in the prehensile member, thereby allowing users to readily replace the cartridge without the risk of releasing small easily-lost components of the operating mechanism.

11 Claims, 6 Drawing Sheets

RETRACTABLE WRITING INSTRUMENT

TECHNICAL FIELD

The present invention relates to writing instruments having a cartridge with a writing tip which may be retracted within the body of the instrument, and particularly to writing instruments having a push-to-extend, push-to-retract operating mechanism.

BACKGROUND OF THE INVENTION

Replacing an ink cartridge (or a pencil cartridge) in a retractable writing instrument having push-to-extend, push-to-retract operating mechanism typically involves unscrewing the two parts forming the body of the pen for access to the cartridge enclosed therein. A number of small components, such as a plunger, rotary ratchet and a helical compression spring, typically come loose or must be removed during this operation. The compression spring may be mounted about the cartridge, with opposing ends abutting a stop on the cartridge and the body respectively, requiring it to be placed about the replacement cartridge, before the rest of the components are carefully re-installed. U.S. Pat. No. 4,991,988 describes a pen with these features. It will therefore be understood that there is a need for an improved retractable writing instrument of this type, which allows users to more readily replace the cartridge without the risk of releasing small easily-lost components. It is an object of the present invention address this need or more generally to provide an improved retractable writing instrument.

DISCLOSURE OF THE INVENTION

According to one aspect of the present invention there is provided a writing instrument for receiving an elongate cartridge having a writing tip at a first end thereof and an opposing second end, the writing instrument comprising:

first and second retainers that are mutually connected to define a chamber having a longitudinal axis;

at least one axially-extending rib disposed on the first retainer, the rib terminating in a tip;

an axially-aligned aperture in the second retainer that is sized for withdrawing and inserting the cartridge therethrough;

a plunger disposed for axial sliding movement in the chamber;

a groove in the plunger, the groove receiving the rib for preventing rotation of the plunger;

a plurality of plunger teeth on the plunger;

a rotary ratchet disposed in the chamber for rotation about the longitudinal axis and sliding movement parallel to the longitudinal axis;

a plurality of ratchet teeth on the ratchet, the ratchet teeth cooperating with and opposing the plunger teeth and rib tip so as to impel rotation of the ratchet about the longitudinal axis when the stem is pressed and released;

a concavity between two of the ratchet teeth;

a longitudinal channel in the ratchet;

a compression spring disposed in the chamber, the compression spring urging the rotary ratchet toward the tip of the rib such that the tip is received in the concavity when the ratchet is in an extended position and the rib is received in the channel when the ratchet is in a retracted position, and prehensile means having a cavity complementary to the second end of the cartridge for grasping the cartridge such that the prehensile means and attached cartridge are moved longitudinally with the rotary ratchet between the extended and retracted positions.

By placing the plunger, rotary ratchet and compression spring within the retainers and providing prehensile means in the manner described, replacement of the cartridge can be performed by simply grasping the cartridge adjacent the writing tip and withdrawing the cartridge from engagement with the prehensile means and then pulling it axially out through the aperture in the second retainer, before inserting a replacement in the reverse manner.

Preferably the prehensile means comprises one or more resilient members disposed about the cavity. Most preferably the prehensile means comprises a resilient sleeve having a longitudinal slot therein. Alternatively, for instance, the prehensile means may comprise one or more fingers circumferentially spaced about the cavity. In this manner the one or more resilient members provide clamping action firmly holding the cartridge. Optionally the prehensile means may be integral with the rotary ratchet. Preferably the mouth of the cavity or the second end of the cartridge are tapered to assist entry of the second end into the cavity.

Preferably the first and second retainers are substantially tubular, the second retainer being received within an inner end of the first retainer and wherein first and second internal abutment faces are disposed on the first and second retainers respectively, opposing ends of the compression spring abutting the first internal abutment face and the resilient sleeve to thereby urge the resilient sleeve against the rotary ratchet.

Preferably the writing instrument further includes a hollow body having a first opening for receiving the writing tip and a second opening for receiving the first and second retainers therethrough. Preferably the hollow body comprises two shells joined at a longitudinal plane, each shell having a recess therein, an insert fixed in the recesses, the insert having an internal screw-thread and wherein the inner end of the first retainer has a screw thread complementary to the thread on the insert for securing the first retainer within the body.

This invention provides a writing instrument which is effective and efficient in operational use, and which has an overall simple design which minimizes manufacturing costs.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
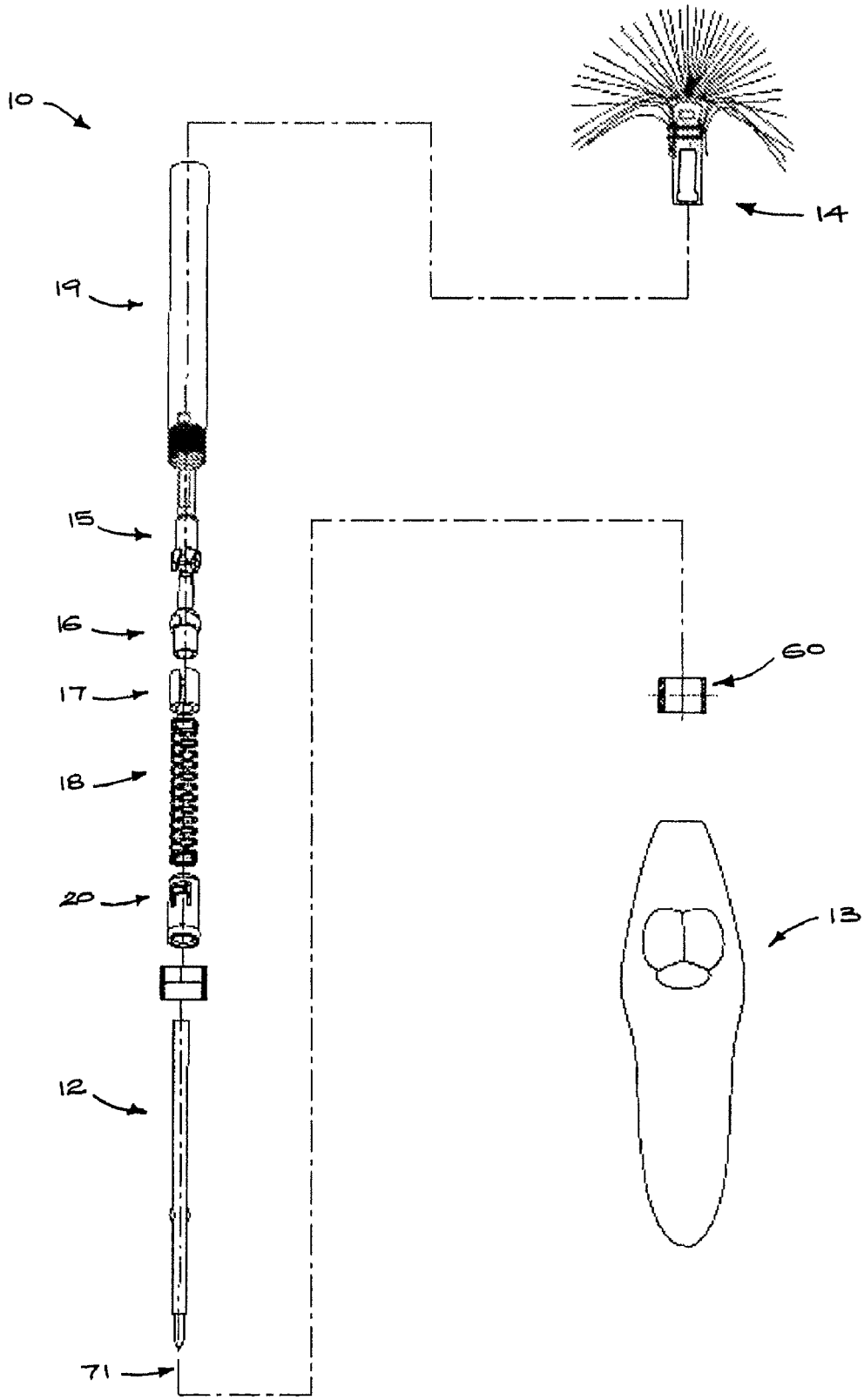
FIG. 1 is an exploded view of a first embodiment of a pen according to the invention.
Figure 2:
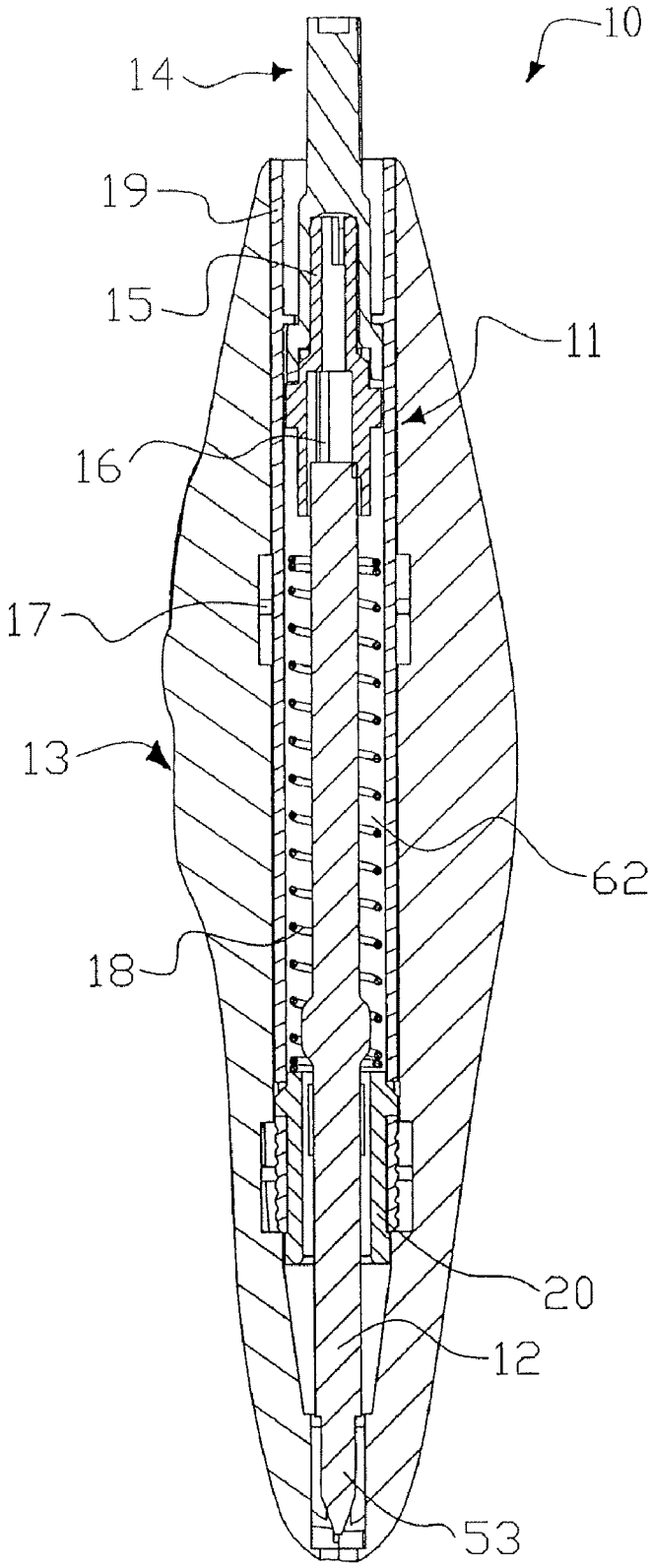
FIG. 2 is a schematic longitudinal sectional view through a second embodiment of a pen of the invention when assembled.

Referring to FIGS. 1 and 2, a retractable writing instrument or pen 10 generally includes a push-to-extend, push-to-retract retractor mechanism 11 and a replaceable ink cartridge 12 held within a body 13. The pen 10 is substantially elongate having a longitudinal axis 71. The writing tip 53 of the ink cartridge 12 projects from the inner end of the pen 10, while the cap 14 by which it is retracted and extended projects from the outer end. The first and second embodiments of FIGS. 1 and 2 differ only in respect of the design of the cap 14, which in the first embodiment includes a decorative cap of threads. As used herein, the term "axial" refers to a direction substantially parallel to the longitudinal axis 71. The term "radial" refers to a direction substantially orthogonal to the longitudinal axis 71. The term "circumferential" refers to the direction of a circular arc having a radius substantially orthogonal to the longitudinal axis 71.

The retractor mechanism 11 is a module that includes a plunger 15, rotary ratchet 16, a prehensile member 17 and a helical compression spring 18 which are generally received within a first retainer 19 and held therein by a second retainer 20.

Figure 3:
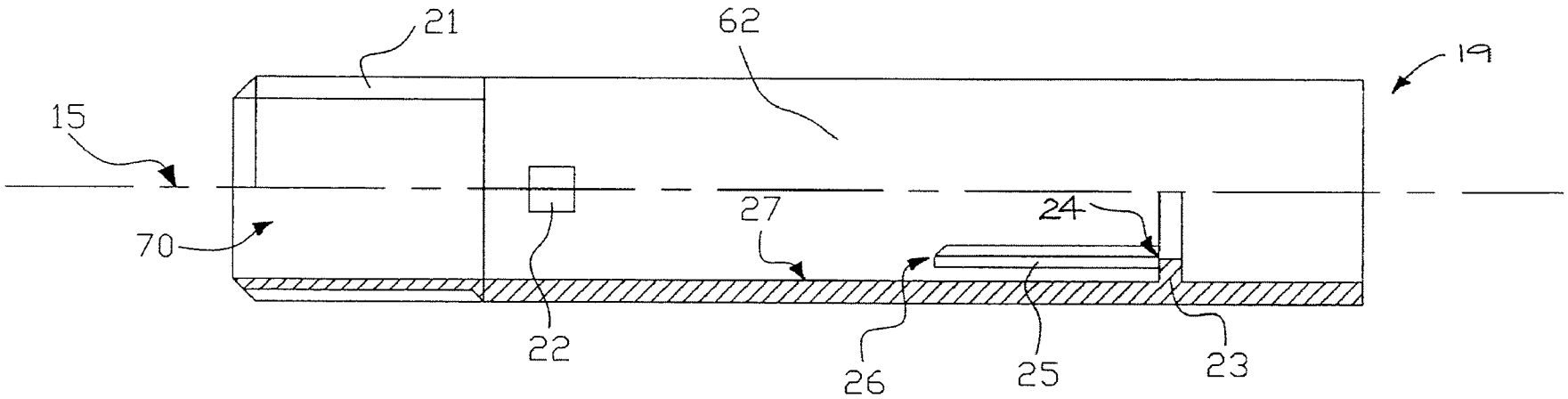
FIG. 3 is a part-sectional side view of the first retainer of the pen of FIG. 1.

The first retainer 19, shown in FIG. 3, is moulded from polymer and has a tubular form with an external screw thread 21 at its inner end. Adjacent the inner end are diametrically opposing square-section openings 22 extending transversely through the side walls. Proximate the outer end an integral annular flange 23 projects inwardly from the cylindrical inner wall 27 and has in inwardly facing abutment face 24. Integral axially-aligned ribs 25 also project inwardly from the cylindrical inner wall 27. Each rib 25 terminates in a tapered tip 26 at its inner end.

Figure 4A:
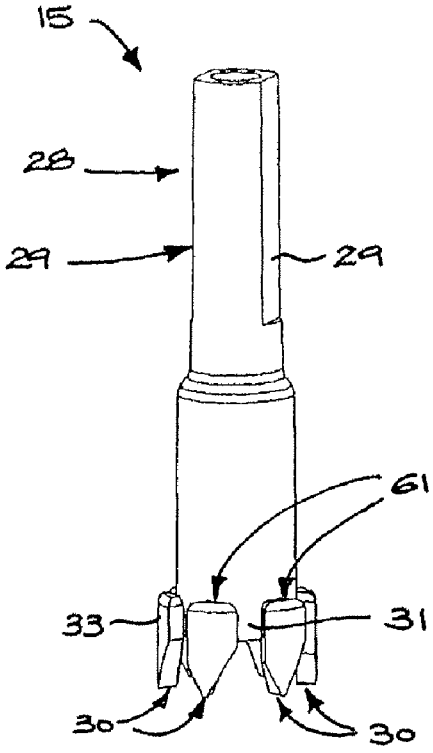
FIG. 4*a* is a pictorial view of the plunger of the pen of FIG. 1.
Figure 4B:
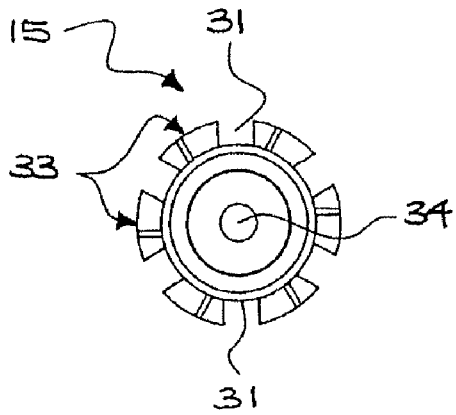
FIG. 4*b* is an end view of the plunger of FIG. 4*a;*

FIGS. 4*a* and 4*b* show the plunger 15, which is also a moulded polymeric component. The plunger 15 is axially elongated having a stem 28 at its outer end with a generally cylindrical surface upon which parallel flats 29 are formed. Facing inwardly and disposed at the inner end of the plunger 15 are a plurality of pointed plunger teeth 30. The teeth 30 are circumferentially spaced apart and each has a partly-cylindrical facet 33 complementary to the inner wall 27. A plurality of faces 61 are aligned in a radial plane. Also formed on the plunger 15 are axially-aligned grooves 31 sized to receive respective ribs 25 in a sliding fit for preventing rotation of the plunger 25 about the axis 71. A blind hole 34 extends axially from the inner end of the plunger 15.

Figure 5A:
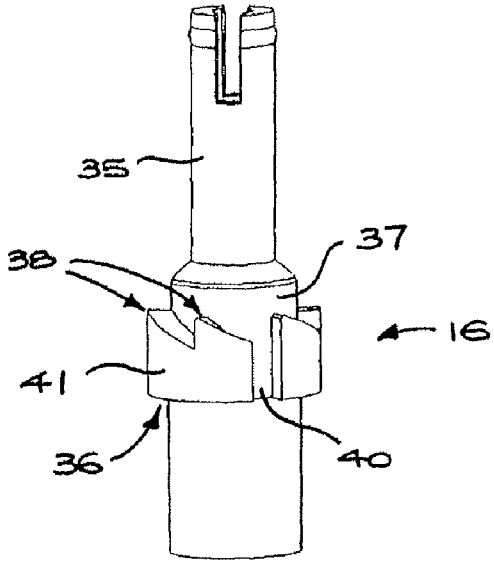
FIG. 5*a* is a pictorial view of the rotary ratchet of the pen of FIG. 1.
Figure 5B:
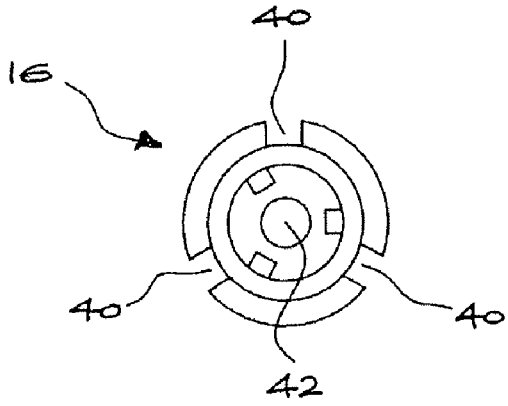
FIG. 5*b* is an end view of the rotary ratchet of FIG. 5*a;*
Figure 6:
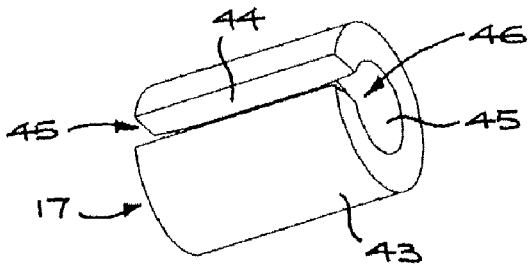
FIG. 6 is a pictorial view of the prehensile member of the pen of FIG. 1.
Figure 7:
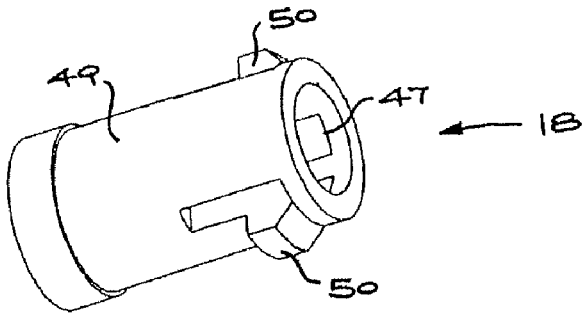
FIG. 7 is a pictorial view of the second retainer of the pen of FIG. 1.
Figure 8:
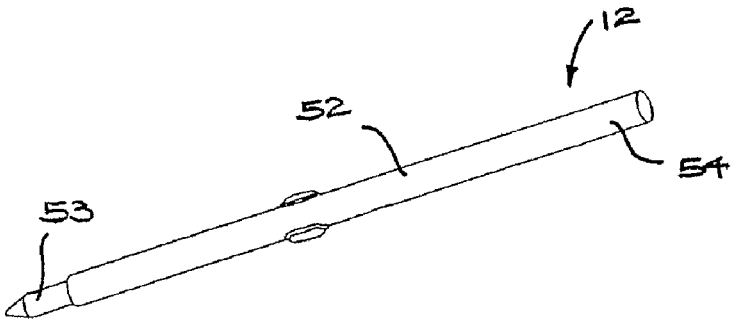
FIG. 8 is a pictorial view of the cartridge of the pen of FIG. 1.
Figure 9:
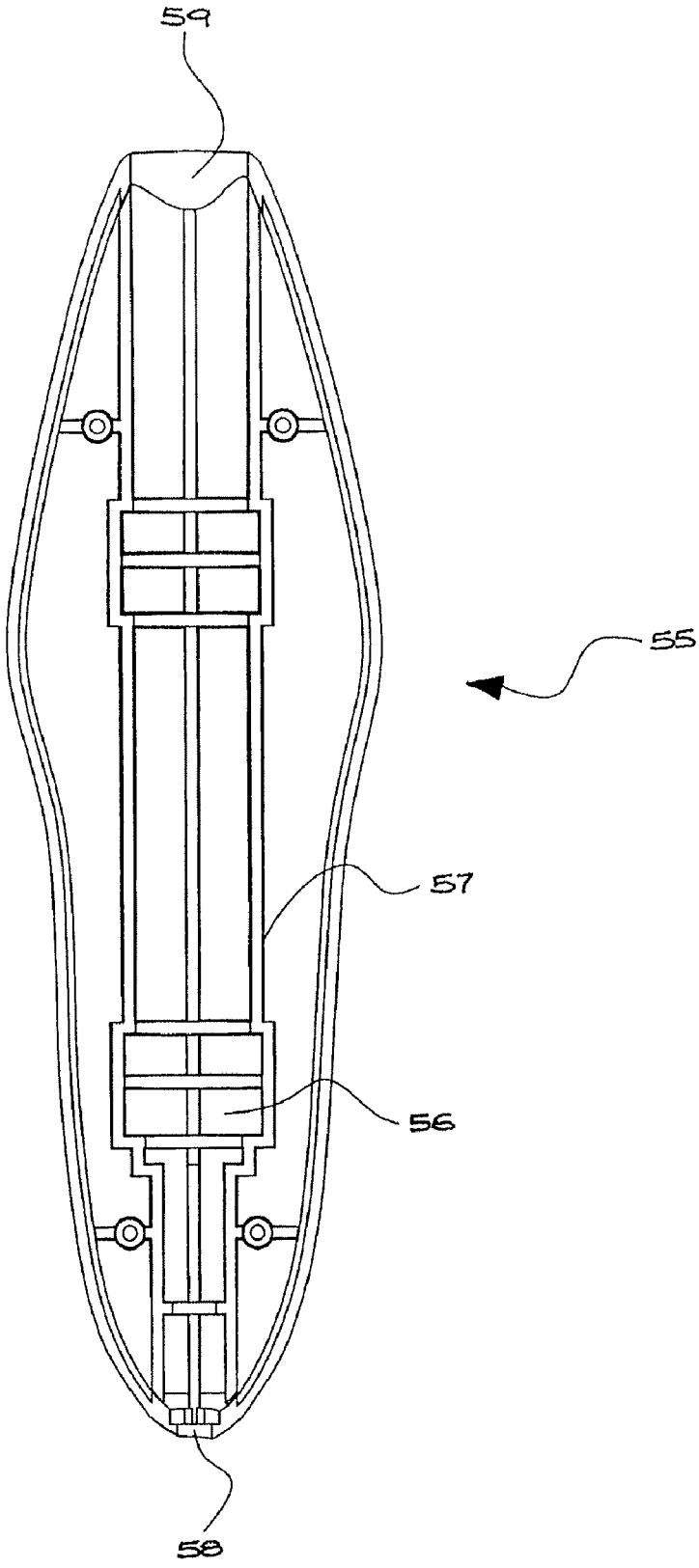
FIG. 9 is a plan view of one of the shells making up the body of the pen of FIG. 1.

The rotary ratchet 16 is shown in FIGS. 5*a* and 5*b* and includes an axial shaft portion 35 received in a sliding fit in the blind hole 34 so as to assist in supporting the rotary ratchet 16 for rotation about the axis 71 and sliding movement parallel to the axis 71. Three projections 36 project radially outward from a cylindrical, axially aligned face 37, each projection 36 defining two tapered ratchet teeth 38 with a an outwardly-opening concavity 39 therebetween. The ratchet teeth 38 face the outer end of the rotary ratchet 16 such that they are opposing the plunger teeth 30. The ratchet teeth 38 are asymmetrical to rotate unidirectionally. Channels 40 in the rotary ratchet 16 are angularly spaced from the ratchet teeth 38 and sized to receive the ribs 25 in a sliding fit. Each projection 36 has a partly-cylindrical facet 41 complementary to the inner wall 27 for supporting the rotary ratchet 16. An aperture 42 extends axially through the rotary ratchet 16.

The prehensile member 17 comprises with a sleeve of resilient polymer having a partly-cylindrical face 43 complementary to the inner wall 27. A slot 44 extends axially through one wall of the sleeve. The through-extending cavity 46 has mouth portions 45 at axially opposing ends, the mouth portions tapering radially inwardly toward the centre of the sleeve.

The second retainer 18 is generally tubular, having an axially-aligned aperture 47 sized for withdrawing and inserting the cartridge 48 therethrough. The outer cylindrical surface 49 is complementary to the inner wall 27 and projecting from it are diametrically opposite lugs 50 sized to be received in the square section openings 22 in the first retainer 19. The second retainer 18 includes an annular abutment face 51.

A first end of the cartridge 12 includes a writing tip 53 holding a ball point (not shown) and a reservoir tube 52 fixed to the writing tip 53. The second end 54 has a cylindrical outer surface sized to be received in the cavity 46.

The hollow body 13 comprises two shells 55 joined at a central longitudinal plane, each shell 55 having a recess 56 therein defined by ribs 57. Openings 58, 59 are formed at axially-opposing ends of the shells, the opening 58 is sized for receiving the writing tip 53, while the opening 59 is sized for receiving the retractor mechanism 11 therethrough. An insert 60 fixed in the recesses 56 has an internal screw-thread 61 complementary to the thread 21 on the first retainer 19. The decorative cap 14 includes a hub 66 with an opening 67 sized to receive the stem 28, the opening including corresponding flats for engaging the flats 29 to prevent relative rotation about axis 71 between the hub 66 and plunger 15. Permanently fixed to the hub 66 is a bunch 68 of multi-coloured elastic strings. The hub 66 itself is also permanently fixed to the stem 28, as by an interference fit.

The first retainer 19 bounds a chamber 62 in which at least part of the plunger 15, rotary ratchet 16, prehensile member 17 and helical compression spring 18 are received and retained. In assembly, the plunger 15 is inserted through the inner end 70 into the chamber 62, the faces 61 abutting the abutment face 24 to retain the plunger 15. This is followed successively by the rotary ratchet 16, prehensile member 17 and helical compression spring 18 before the second retainer 20 is fixed in the inner end 70. In this manner opposing ends of the compression spring 18 abut the abutment face 51 and the prehensile member 17. The first and second retainers are flexible and resilient allowing them to deflect as the second retainer 18 is inserted into the inner end 70 and they are thus connected as the lugs 50 are received in the openings 22. The resulting module or retractor mechanism 11 is assembled for the life of the pen and can be used with cartridges and writing instrument bodies of many different types.

The outer end 54 of the cartridge 12 is inserted through the aperture 47 into the cavity 46 in the prehensile member 17. The tapered mouth 45 assists entry of the end 54 into the cavity and further insertion along the tapered mouth 45 resiliently deforms the sleeve thereby providing a clamping action or interference fit firmly holding the cartridge 12. The spring 18 urges the prehensile member 17 against the rotary ratchet 16 with radially-aligned faces on each abutting. In this manner the prehensile member 17 follows the axial movement of the rotary ratchet 16 between retracted position (shown in FIG. 2) and an extended position (not shown), but is not restrained to rotate with the rotary ratchet 16. Correspondingly, the cartridge 12 can be readily removed by withdrawing the cartridge from engagement with the prehensile member 17 and then pulling it axially out through the aperture 47. The retractor mechanism 11 and attached cartridge 12 are then inserted into the body 13, while engaging the screw threads 21, 61.

In operation, the cap 65 is toggled (alternately pushed, then released) to extend and retract the cartridge 12 in the well-known manner. In the retracted position shown in FIG. 2 the rotary ratchet teeth 38 are held in engagement with the plunger teeth 30, the faces 61 abutting the abutment face 24, and the rib 25 is received in the channel 31. In the extended position the rotary ratchet 16 is urged by the spring 18 into engagement with the rib 25, with the tip 26 of the rib 25 received in the concavity 39. The ratchet teeth 38 cooperate with the plunger teeth 30 and rib tip 26 so as to impel a first small rotation of the rotary ratchet 16 when the cap is pressed and a second small rotation when the cap is released.

Aspects of the present invention have been described by way of example only and it should be appreciated that modifications and additions may be made thereto without departing from the scope thereof.

The invention claimed is:

1. A writing instrument for receiving an elongate cartridge having a writing tip at a first end thereof and an opposing second end, the writing instrument comprising:

first and second retainers that are mutually connected to define a chamber having a longitudinal axis;

at least one axially-extending rib disposed on the first retainer, the rib terminating in a tip;

an axially-aligned aperture in the second retainer that is sized for withdrawing and inserting the cartridge therethrough;

a plunger held in the chamber for axial sliding movement;

a groove in the plunger, the groove receiving the rib for preventing rotation of the plunger;

a plurality of plunger teeth on the plunger;

a rotary ratchet held in the chamber for rotation about the longitudinal axis and sliding movement parallel to the longitudinal axis;

a plurality of ratchet teeth on the ratchet, the ratchet teeth cooperating with and opposing the plunger teeth and rib tip so as to impel rotation of the ratchet about the longitudinal axis when a stem is pressed and released;

a concavity between two of the ratchet teeth;

a longitudinal channel in the ratchet;

a compression spring disposed in the chamber, the compression spring urging the rotary ratchet toward the tip of the rib such that the tip is received in the concavity when the ratchet is in an extended position and the rib is received in the channel when the ratchet is in a retracted position, and prehensile means having a cavity complementary to the second end of the cartridge for grasping the cartridge such that the prehensile means and attached cartridge are moved longitudinally with the rotary ratchet between the extended and retracted positions.

2. The writing instrument of claim 1 wherein the prehensile means comprises one or more resilient members disposed about the cavity.

3. The writing instrument of claim 2 wherein the prehensile means comprises a resilient sleeve having a longitudinal slot therein.

4. The writing instrument of claim 2 wherein the mouth of the cavity or the second end of the cartridge are tapered to assist entry of the second end into the cavity.

5. The writing instrument of claim 4 wherein the first and second retainers are substantially tubular, the second retainer being received within an inner end of the first retainer and wherein first and second internal abutment faces are disposed on the first and second retainers respectively, opposing ends of the compression spring abutting the first internal abutment face and the resilient sleeve to thereby urge the resilient sleeve against the rotary ratchet.

6. The writing instrument of claim 1 further including a hollow body having a first relatively small opening receiving the writing tip and a second relatively larger opening for receiving the first and second retainers therethrough.

7. The writing instrument of claim 6 wherein the hollow body comprises two shells joined at a longitudinal plane, each shell having a recess therein, an insert fixed in the recesses, the insert having an internal screw-thread and wherein the inner end of the first retainer has a screw thread complementary to the thread on the insert for securing the first retainer within the body.

8. A writing instrument comprising:

an elongate cartridge having a writing tip at a first end thereof and an opposing second end;

first and second retainers that are mutually connected to define a chamber having a longitudinal axis;

at least one axially-extending rib disposed on the first retainer, the rib terminating in a tip;

an axially-aligned aperture in the second retainer that is sized for withdrawing and inserting the cartridge therethrough;

a plunger held in the chamber for axial sliding movement;

a groove in the plunger, the groove receiving the rib for preventing rotation of the plunger;

a plurality of plunger teeth on the plunger;

a rotary ratchet held in the chamber for rotation about the longitudinal axis and sliding movement parallel to the longitudinal axis;

a plurality of ratchet teeth on the ratchet, the ratchet teeth cooperating with and opposing the plunger teeth and rib tip so as to impel rotation of the ratchet about the longitudinal axis when a stem is pressed and released;

a concavity between two of the ratchet teeth;

a longitudinal channel in the ratchet;

a compression spring disposed in the chamber, the compression spring urging the rotary ratchet toward the tip of the rib such that the tip is received in the concavity when the ratchet is in an extended position and the rib is received in the channel when the ratchet is in a retracted position;

one or more resilient members defining a cavity receiving the second end of the cartridge, the mouth of the cavity or the second end of the cartridge are tapered to assist entry of the second end into the cavity and deflect the one or more resilient members such that the one or more resilient members grasp the cartridge and are moved longitudinally with the rotary ratchet between the extended and retracted positions, and a hollow body having a first relatively small opening receiving the writing tip and a second relatively larger opening for insertion of the first and second retainers thereinto.

9. The writing instrument of claim 8 wherein the one or more resilient members comprises a resilient sleeve having a longitudinal slot therein.

10. The writing instrument of claim 9 wherein the first and second retainers are substantially tubular, the second retainer being received within an inner end of the first retainer and wherein first and second internal abutment faces are disposed on the first and second retainers respectively, opposing ends of the compression spring abutting the first internal abutment face and the resilient sleeve to thereby urge the resilient sleeve against the rotary ratchet.

11. The writing instrument of claim 10 wherein the hollow body comprises two shells joined at a longitudinal plane, each shell having a recess therein, an insert fixed in the recesses, the insert having an internal screw-thread and wherein the inner end of the first retainer has a screw thread complementary to the thread on the insert for securing the first retainer within the body.

* * * * *